US010559446B2

(12) United States Patent
Jeong et al.

(10) Patent No.: US 10,559,446 B2
(45) Date of Patent: Feb. 11, 2020

(54) VACUUM CLOSED TUBE AND X-RAY SOURCE INCLUDING THE SAME

(71) Applicant: ELECTRONICS AND TELECOMMUNICATIONS RESEARCH INSTITUTE, Daejeon (KR)

(72) Inventors: Jin-Woo Jeong, Daejeon (KR); Yoon-Ho Song, Daejeon (KR); Jun Tae Kang, Daejeon (KR); Jae-Woo Kim, Daejeon (KR)

(73) Assignee: Electronics and Telecommunication Research Institute, Daejeon (KR)

( * ) Notice: Subject to any disclaimer, the term of this patent is extended or adjusted under 35 U.S.C. 154(b) by 89 days.

(21) Appl. No.: 15/904,820

(22) Filed: Feb. 26, 2018

(65) Prior Publication Data

US 2018/0247787 A1 Aug. 30, 2018

(30) Foreign Application Priority Data

Feb. 28, 2017 (KR) ..... 10-2017-0026681
Feb. 12, 2018 (KR) ..... 10-2018-0017261

(51) Int. Cl.
*H01J 35/00* (2006.01)
*H01J 35/14* (2006.01)
(Continued)

(52) U.S. Cl.
CPC ..... *H01J 35/14* (2013.01); *G21K 1/02* (2013.01); *H01J 35/045* (2013.01); *H01J 35/06* (2013.01); *H01J 35/16* (2013.01); *H05G 1/52* (2013.01); *H01J 2235/062* (2013.01); *H01J 2235/16* (2013.01)

(58) Field of Classification Search
None
See application file for complete search history.

(56) References Cited

U.S. PATENT DOCUMENTS 5,629,969 A 5/1997 Koshishiba
8,761,343 B2 6/2014 Jeong et al.
(Continued)

FOREIGN PATENT DOCUMENTS

JP 2010080347 A 4/2010
JP 2012049122 A 3/2012
(Continued)

*Primary Examiner* — Hoon K Song
(74) *Attorney, Agent, or Firm* — Rabin & Berdo, P.C.

(57) ABSTRACT

Provided is an X-ray source including a vacuum closed tube. The X-ray source includes a high voltage connection module, a tube module, and a magnetic lens system into which the tube module is inserted. The tube module includes a vacuum closed tube. The vacuum closed tube includes a cathode electrode provided at one end thereof, a nano-emitter on the cathode electrode, an anode electrode provided at the other end, and a first insulation spacer provided between the cathode electrode and the anode electrode. In addition, the vacuum closed tube includes a first conductive tube and a second conductive tube both provided between the cathode electrode and the anode electrode and separated from each other by the first insulation spacer, and a first collimator block covering an inner surface of the first insulation spacer and having a first opening.

17 Claims, 12 Drawing Sheets

(51) Int. Cl.

| | |
|---|---|
| ***G21K 1/02*** | (2006.01) |
| ***H01J 35/16*** | (2006.01) |
| ***H01J 35/06*** | (2006.01) |
| ***H05G 1/52*** | (2006.01) |
| ***H01J 35/04*** | (2006.01) |

(56) References Cited

U.S. PATENT DOCUMENTS

| | | | | |
|---|---|---|---|---|
| 2009/0010393 | A1* | 1/2009 | Klinkowstein | H05G 1/10 378/140 |
| 2012/0027177 | A1 | 2/2012 | Ogata et al. | |
| 2013/0028386 | A1* | 1/2013 | Jeong | H01J 35/20 378/122 |
| 2013/0129046 | A1* | 5/2013 | Yamazaki | H01J 35/02 378/62 |
| 2013/0336461 | A1 | 12/2013 | Jeong et al. | |
| 2013/0336462 | A1* | 12/2013 | Suzuki | H01J 35/02 378/141 |
| 2014/0233696 | A1* | 8/2014 | Utsumi | A61B 6/40 378/21 |
| 2016/0290936 | A1 | 10/2016 | Jeong et al. | |
| 2017/0110283 | A1* | 4/2017 | Shirota | H01J 35/14 |

FOREIGN PATENT DOCUMENTS

| | | | |
|---|---|---|---|
| KR | 2012-0064783 | A | 6/2012 |
| KR | 101211639 | B1 | 12/2012 |
| KR | 2015-0051820 | A | 5/2015 |
| KR | 2016-0118637 | A | 10/2016 |

* cited by examiner

VACUUM CLOSED TUBE AND X-RAY SOURCE INCLUDING THE SAME

CROSS-REFERENCE TO RELATED APPLICATIONS

This U.S. non-provisional patent application claims priority under 35 U.S.C. § 119 of Korean Patent Applications No. 10-2017-0026681 and No. 10-2018-0017261, filed on Feb. 28, 2017 and on Feb. 12, 2018 respectively, the entire contents of which are hereby incorporated by reference.

BACKGROUND

The present disclosure herein relates to a vacuum closed tube and an X-ray source including the same, and more particularly, to a vacuum closed tube including a nano-emitter and an X-ray source including the same.

As the structure of a semiconductor chip becomes finer and multi-layered, there is a growing demand for non-destructive analysis of a microstructure. Computed tomography (CT) using an X-ray, which is the most effective method of non-destructive analysis methods, is widely used. In order to analyze a microstructure using CT, a generation point of a generated X-ray, that is, a focal spot of an accelerated electron beam must be reduced to a nanometer scale. To this end, an electron beam emitted from an electron emission source of high luminance may be collided with a transmissive anode target through the focusing of a magnetic lens.

As an electron emission source of high luminance, a thermal electron emission source such as tungsten or $LaB_6$ is commonly used, and to use such an electron source, an open-type X-ray tube with a vacuum pumping system is used. An emitted electron beam is reduced to have a very small diameter of a nanometer scale by a magnetic lens and at the same time is often accelerated commonly by 100 kV or more and then collides with a transmissive anode to generate an X-ray. Such an open-type X-ray tube with a vacuum pump requires a vibration reduction method such as fixing the tube on a very heavy object such as a stone quartz panel since the vibration of the pump affects the quality of an X-ray image. Such a pump system and a vibration reduction device cause a nano-focus CT system to become huge. In addition, such a pump system may make maintenance and repair of a nano-focus CT system difficult.

SUMMARY

The present disclosure provides an X-ray source not requiring a vacuum pumping system.

The present disclosure also provides an X-ray source providing an electron beam focused to be of a nano size.

The present disclosure also provides a vacuum closed tube with improved insulation properties in order to facilitate separation.

The present disclosure also provides an X-ray source capable of measuring the degree of focusing while protecting an insulation spacer.

An embodiment of the inventive concept provides an X-ray source including a high voltage connection module, a tube module, and a magnetic lens system into which the tube module is inserted, wherein the tube module includes a vacuum closed tube, and the vacuum closed tube includes: a cathode electrode provided at one end thereof; a nano-emitter on the cathode electrode; an anode electrode provided at the other end; a first insulation spacer provided between the cathode electrode and the anode electrode; a first conductive tube and a second conductive tube both provided between the cathode electrode and the anode electrode and separated from each other by the first insulation spacer; and a first collimator block covering an inner surface of the first insulation spacer and having a first opening.

In an embodiment, the first collimator block may be electrically connected to the first conductive tube. The magnetic lens system may include a magnetic structure including a gap portion and a coil in the magnetic structure, and the first collimator block may be disposed in the gap portion. The gap portion may be defined by a first surface and a second surface of the magnetic structure, and the distance between an inner surface of the first collimator block connected to the first opening and the first surface may be substantially the same as the distance between the inner surface and the second surface.

In an embodiment, the vacuum closed tube may further include a third conductive tube spaced apart from the first conductive tube by the second conductive tube interposed therebetween; a second insulation spacer separating the second conductive tube and the third conductive tube; and a second collimator block covering an inner surface of the second insulation spacer and having a second opening. The diameter of the second opening may be smaller than the diameter of the first opening. The high voltage connection module may include a first insulation part, the tube module may include a second insulation part, and the first insulation part and the second insulation part may each include a concave-convex structure. The vacuum closed tube may further include a fourth conductive tube between the first conductive tube and the first insulation spacer; and a fifth conductive tube between the second conductive tube and the first insulation spacer. The fourth conductive tube may be screw-coupled with the first conductive tube, and the fifth conductive tube may be screw-coupled with the second conductive tube. The fourth conductive tube may include a first sub-conductive tube and a second sub-conductive tube, and the second sub-conductive tube may be thinner than the first sub-conductive tube.

In an embodiment of the inventive concept, a vacuum closed tube includes a cathode electrode and an anode electrode; a nano-emitter on the cathode electrode; a first insulation spacer provided between the cathode electrode and the anode electrode; a first conductive tube and a second conductive tube both provided between the cathode electrode and the anode electrode and separated from each other by the first insulation spacer; and a first collimator block covering an inner surface of the first insulation spacer, electrically connected to the first conductive tube, and having a first opening.

In an embodiment, the first collimator block may include a flange part protruding toward an inner surface of the first conductive tube. The vacuum closed tube may further include a third conductive tube spaced apart from the first conductive tube by the second conductive tube interposed therebetween; a second insulation spacer separating the second conductive tube and the third conductive tube; and a second collimator block covering an inner surface of the second insulation spacer, electrically connected to the second conductive tube, and having a second opening.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Exemplary embodiments of the inventive concept will be described below in more detail with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art. Those skilled in the art will recognize that the concepts of the inventive concept may be performed in any suitable environment.

The terms used herein is for the purpose of describing embodiments and is not intended to limit the inventive concept. In the present specification, singular forms include plural forms unless the context clearly dictates otherwise. As used herein, the terms "comprises" and/or "comprising" are intended to be inclusive of the stated components, steps, operations and/or elements, and do not preclude the presence or addition of one or more other components, steps, operations, and/or elements.

In the present specification, when a film (or layer) is referred to be on another film (or layer) or substrate, it may be formed directly on another film (or layer) or substrate, or a third film (or layer) may be interposed therebetween.

Although the terms first, second, third, etc. have been used in various embodiments herein to describe various regions, films (or layers), etc., it is to be understood that these regions, films, etc. should not be limited by these terms. These terms are merely used to distinguish any given region or film (or layer) from another region or film (or layer). Thus, the membrane referred to as the first membrane in an embodiment may be referred to as the second membrane in another embodiment. Each embodiment described and exemplified herein also includes its complementary embodiment. Like numbers refer to like elements throughout the specification.

The terms used in the embodiments of the inventive concept may be interpreted as commonly known to those skilled in the art unless otherwise defined.

Hereinafter, an electron emission source and an X-ray generator according to the concept of the inventive concept will be described with reference to the accompanying drawings.

Figure 1:
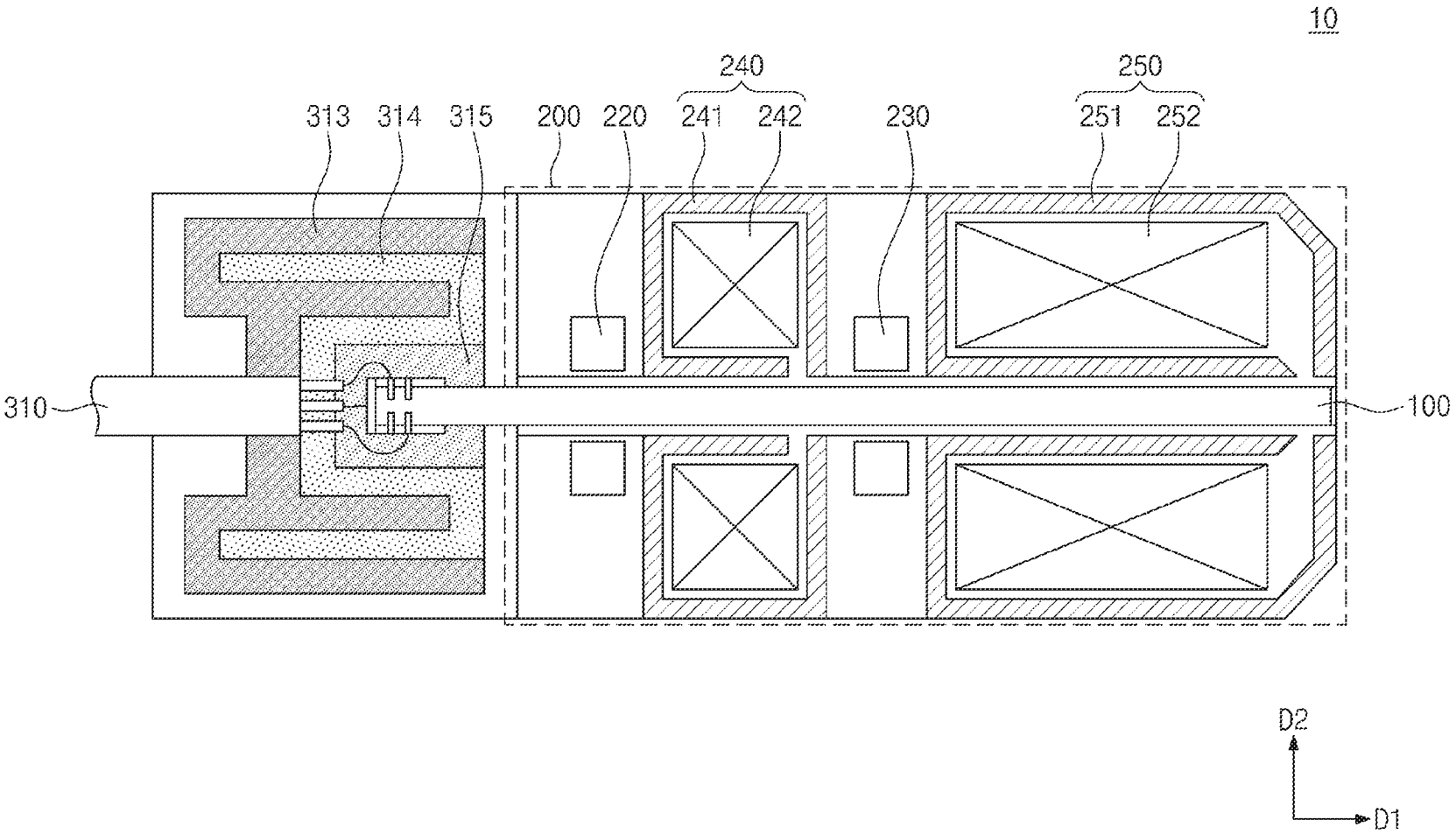
FIG. 1 is a cross-sectional view of an X-ray source according to embodiments of the inventive concept.
Figure 2:
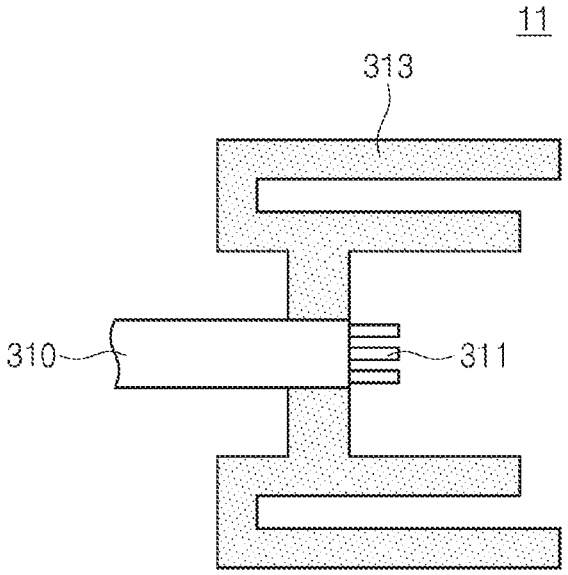
FIG. 2 is a cross-sectional view of a high voltage connection module.
Figure 3:
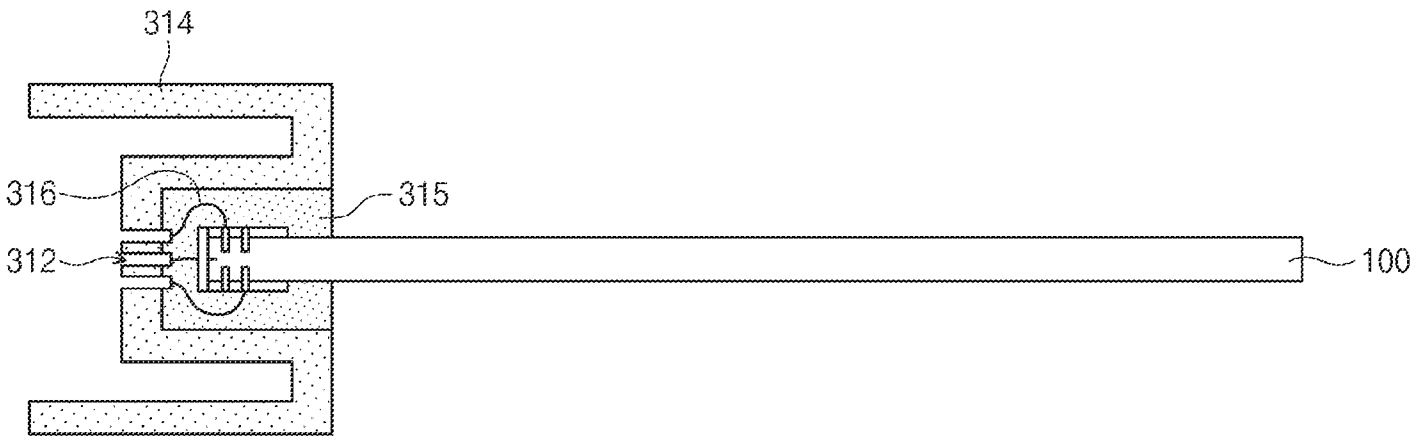
FIG. 3 is a cross-sectional view of a tube module.
Figure 4:
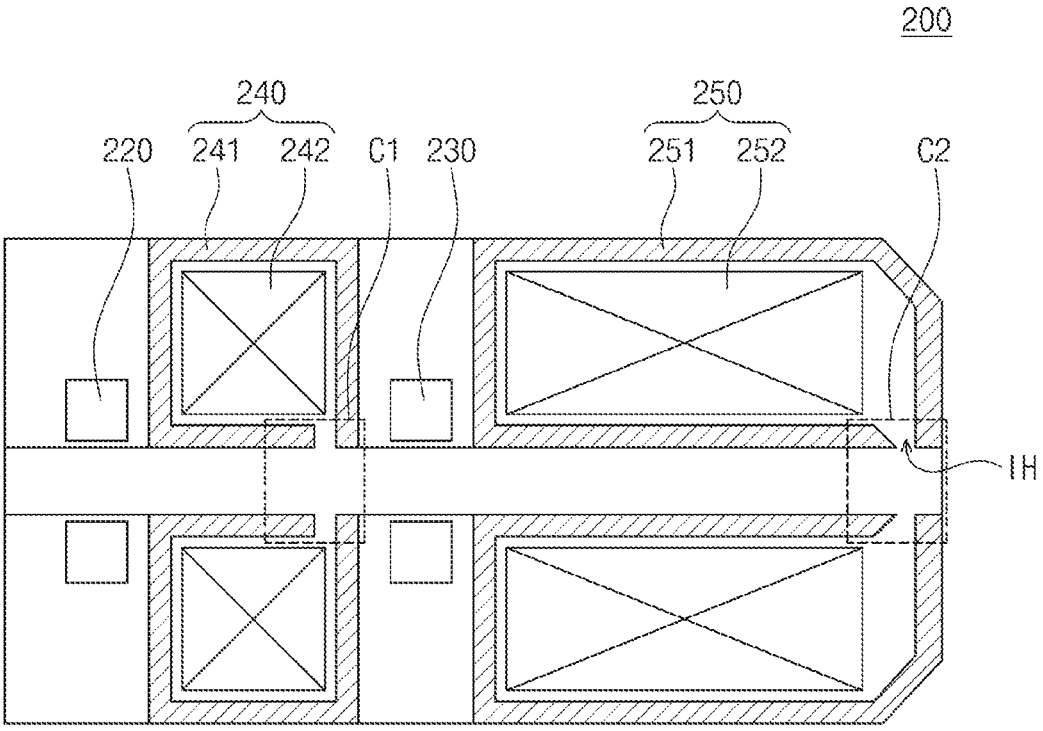
FIG. 4 is a cross-sectional view of a magnetic lens system.

FIG. 1 is a cross-sectional view of an X-ray source according to embodiments of the inventive concept. FIG. 2 is a cross-sectional view of a high voltage connection module 11. FIG. 3 is a cross-sectional view of a tube module 12. FIG. 4 is a cross-sectional view of a magnetic lens system 200.

Referring to FIGS. 1 to 4, an X-ray source 10 according to embodiments of the inventive concept may be provided. The X-ray source 10 may include the high voltage connection module 11, the tube module 12, and the magnetic lens system 200. The high voltage connection module 11 may include a power cable 310, a cable connector 311 provided at one end of the power cable 310, and a first insulation part 313. The first insulation part 313 may include a concave-convex structure which may be coupled to a second insulation part to be described below. As an example, the first insulation part 313 may include an insulation material such as plastic.

The tube module 12 may include a vacuum closed tube 100 and a second insulation part 314 provided at one end of the vacuum closed tube 100. The second insulation part 314 may include a concave-convex structure which may be coupled to the first insulation part 313. In an embodiment, the second insulation part 314 may include connector holes 312 capable of accommodating the cable connector 311. The second insulation part 314 may include the same insulation material as the first insulation part 313. Due to the convex-concave structure and/or a corrugated structure between the first and the second insulation parts 313 and 314, the voltage withstanding properties of the X-ray source 10 may be increased, and the tube module 12 completely used may be easily separated from the X-ray source 10 and replaced. The shape and form of the concave-convex structure and/or the corrugated structure of the first and second insulation parts 313 and 314 may be changed according to the required voltage withstanding properties. Between the second insulation part 314 and the vacuum closed tube 100, a molding insulation part 315 may be provided. The molding insulation part 315 may include a material having high insulation properties such as epoxy. In the molding insulation part 315, wirings 316 may be provided to electrically connect the vacuum closed tube 100 and the cable connector 311. The wirings 316 may be connected to electrodes of the vacuum closed tube 100 to be described below. The connection structure and the method thereof between the vacuum closed tube 100 and the power cable 310 are not limited to the illustrated content, and may be changed as needed.

As shown in FIG. 4, the magnetic lens system 200 may include an insertion hole IH into which the vacuum closed tube 100 is inserted. The magnetic lens system 200 may include a plurality of magnetic lens 240 and 250 to focus an electron beam emitted from the vacuum closed tube 100. Hereinafter, a magnetic lens and a deflector are each described to be in a plurality. However, the magnetic lens system 200 may be composed of one magnetic lens and one deflector.

As an example, the magnetic lens system 200 may include a first magnetic lens 240 and a second magnetic lens 250 both spaced apart in a first direction D1. The first magnetic lens 240 may be a condenser lens for controlling initial focusing properties, and the second magnetic lens 250 may be an objective lens for determining a size of the final electron beam. The first magnetic lens 240 may include a first magnetic structure 241 and a first coil 242 disposed in the first magnetic structure 241. The second magnetic lens 250 may include a second magnetic structure 251 and a second coil 252 disposed in the second magnetic structure 251. As an example, the first and the second magnetic structures 241 and 251 may be manufactured of pure iron.

The first magnetic lens 240 may include a first deflector 220, and the second magnetic lens 250 may include a second deflector 230. As an example, the first and the second deflectors 220 and 230 may be alignment coils. The first and the second deflectors 220 and 230 may respectively surround the vacuum closed tube 100. The shapes of the magnetic lens 240 and 250 and the deflectors 220 and 230 are not limited to the illustrated content, and may be changed as needed. As an example, the first deflector 220 may be positioned inside the first magnetic lens 240, and the second deflector 230 may be positioned inside the second magnetic lens 250, inside the first magnetic lens 240, or between the first deflector 220 and the first magnetic lens 240. As an example, the first deflector 220 and the second deflector 230 may each include an alignment coil disposed in a deflector module case.

The first magnetic lens 240 may include a first coil region C1 corresponding to an opening of the first magnetic structure 241. The first coil region C1 may be a position on which a generated magnetic field is focused. Similarly, the second magnetic lens 250 may include a second coil region C2 corresponding to an opening of the second magnetic structure 251.

Figure 5:
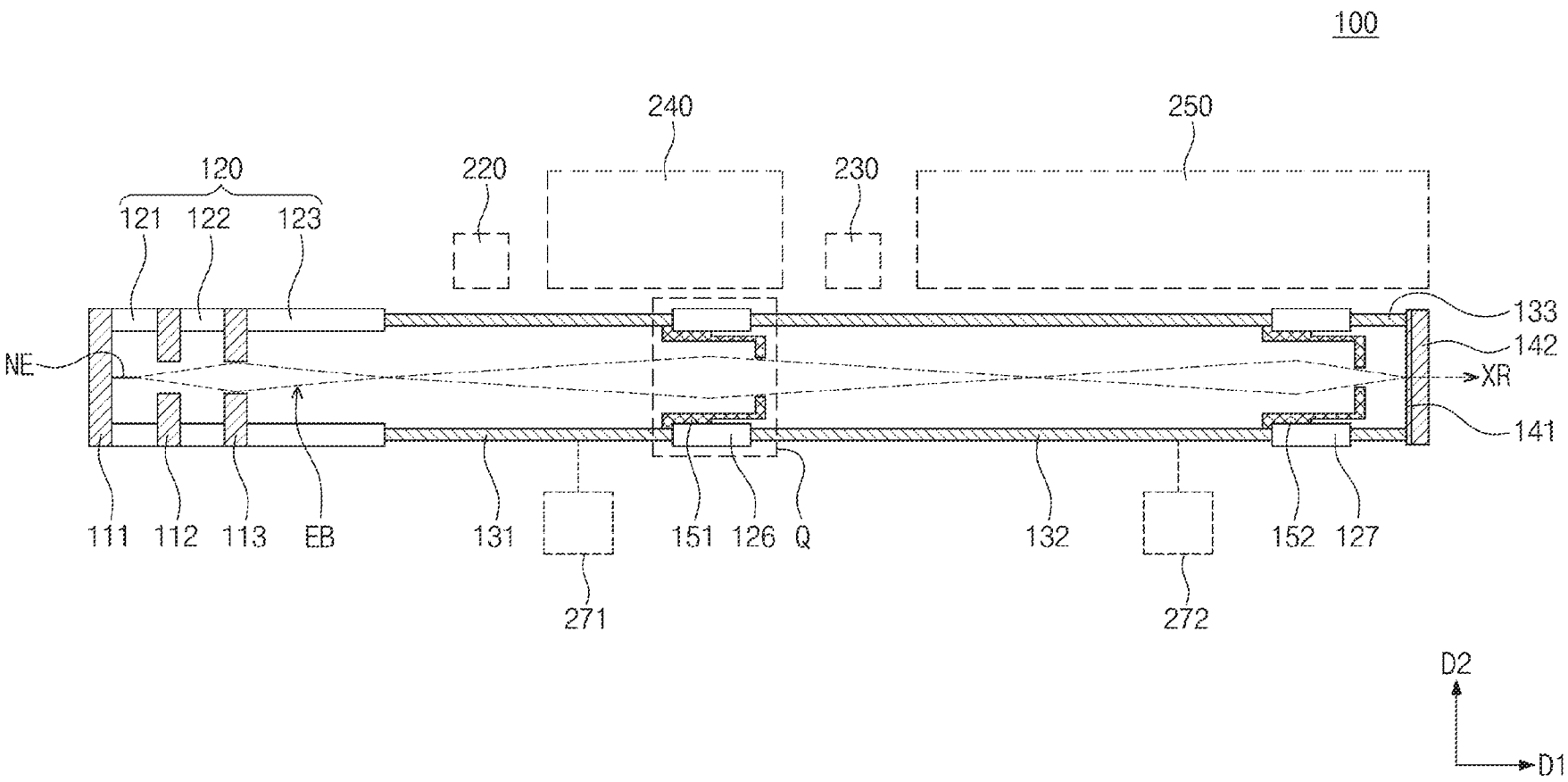
FIG. 5 is a cross-sectional view of a vacuum closed tube according to embodiments of the inventive concept.
Figure 6:
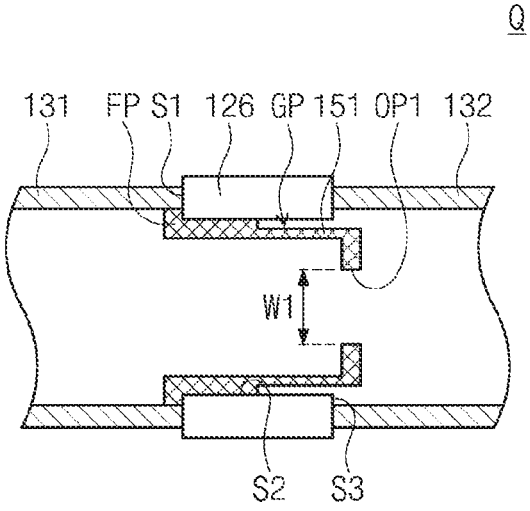
FIG. 6 is an enlarged view of a portion Q of FIG. 5.
Figure 7A:
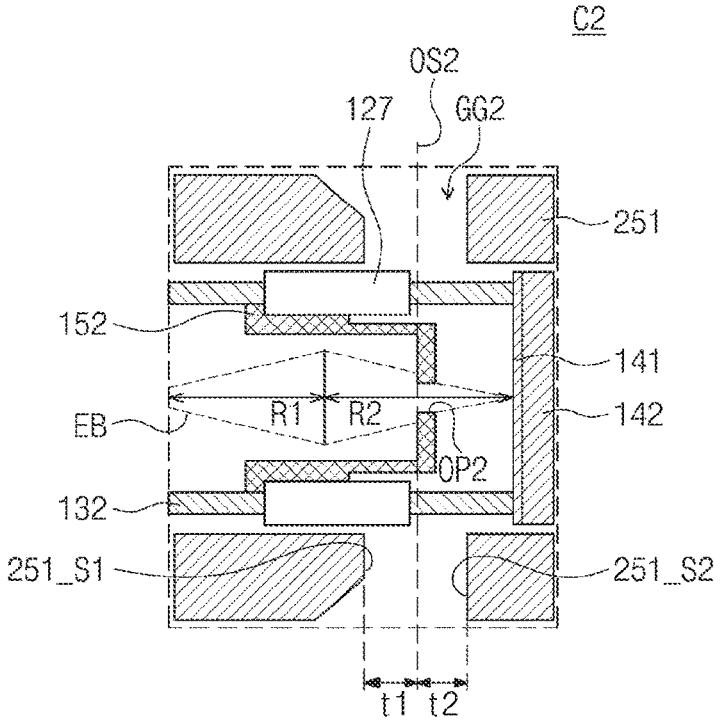
FIG. 7A is an enlarged view of a portion C1 of FIG. 4.
Figure 7B:
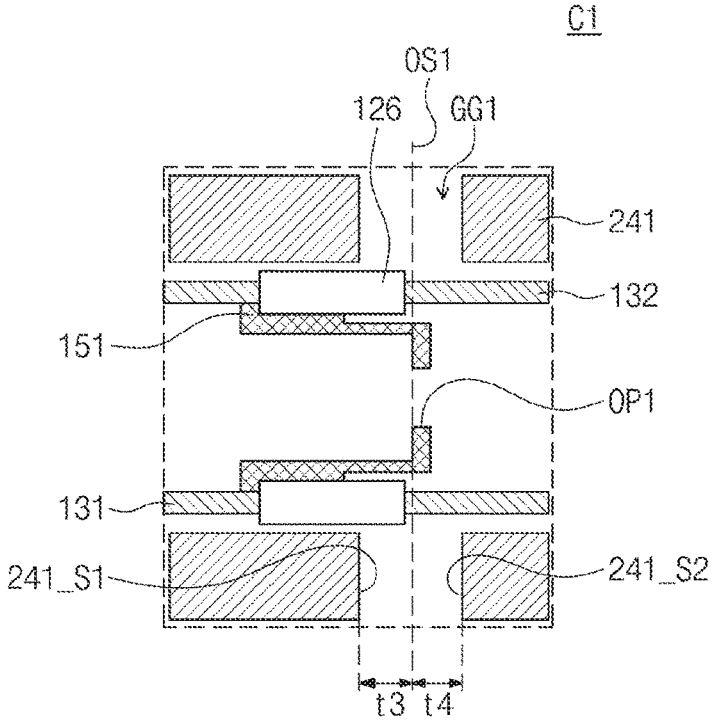
FIG. 7B is an enlarged view of a portion C2 of FIG. 4.

FIG. 5 is a cross-sectional view of a vacuum closed tube according to embodiments of the inventive concept. FIG. 6 is an enlarged view of a portion Q of FIG. 5. FIG. 7A is an enlarged view of a portion C1 of FIG. 4. FIG. 7B is an enlarged view of a portion C2 of FIG. 4.

Referring to FIGS. 5 and 6, the vacuum closed tube 100 according embodiments of the inventive concept includes a cathode electrode 111 at one end thereof and an anode electrode 141 at the other end. The anode electrode 141 may be spaced apart in the first direction D1 which is a direction in which an electron beam EB is emitted from the cathode electrode 111. The vacuum closed tube 100 may have a vacuum closed tube structure between the cathode electrode 111 and the anode electrode 141 in configurations to be described below.

An electron emission source may be provided. The electron emission source may emit electrons in an electric field. As an example, on the cathode electrode 111, a nano-emitter NE may be provided. As an example, the nano-emitter NE may be a carbon nano-tube. The carbon nano-tube may be in the form of a tube having a hollow inside thereof in which carbons are coupled in a hexagonal shape are connected to each other. As an example, the nano-emitter NE may be provided in the form of a carbon nano-tube yarn, or a printed CNT multi-emitter. As an example, the nano-emitter NE may include at least one carbon nano-tube arranged in a dot array form.

The electron beam EB emitted from the nano-emitter NE may collide with the anode electrode 141, that is, a target, to generate an X-ray XR. The generated X-ray XR may transmit a window 142 disposed on one surface of the anode electrode 141 and be emitted to the outside. As an example, the window 142 may be formed of a single material such as beryllium, aluminum, copper, or an alloy thereof. The anode electrode 141 may be provided by performing a deposition process on the window 142 by a sputtering method.

Between the cathode electrode 111 and the anode electrode 141, a gate electrode 112 may be provided. The gate electrode 112 may be electrically separated from the cathode electrode 111 by a first insulation ring 121 interposed therebetween. In an embodiment, between the gate electrode 112 and the anode electrode 141, a focus electrode 113 may be provided. In this case, between the gate electrode 112 and the focus electrode 113, a second insulation ring 122 may be provided. As an example, at one side of the focus electrode 113, the second insulation ring 122 may be provided, and at the other side, a third insulation ring 123 may be provided. The third insulation ring 123 may be longer than the first and the second insulation rings 121 and 122, but is not limited thereto.

The gate electrode 112 and the focus electrode 113 may focus the electron beam EB emitted from the nano-emitter NE. When a potential difference is generated between the gate electrode 113 and the cathode electrode 111, the electron beam EB may be emitted from an end of the nano-emitter NE toward the gate electrode 112. At this time, the path of the electron beam EB may be bent due to the potential difference between the gate electrode 112 and the focus electrode 113 and the potential difference between the anode electrode 141 and the focus electrode 113, and may be accelerated and focused through the control of a relative potential and an electrode shape. For an emission of the electron beam EB, the potential of the gate electrode 112 may be higher than that of the cathode electrode 111. The potential of the anode electrode 141 may be higher than that of the cathode electrode 111. As an example, conductive tubes 131 to 133 may be equipotential with the anode electrode 141. The conductive tubes 131 to 133 and the anode electrode 141 may be grounded OV, and the electrodes 111 to 113 may have negative potentials.

The cathode electrode 111, the gate electrode 112, and the focus electrode 113 may include a metal material such as copper (Cu), aluminum (Al), and molybdenum (Mo). The anode electrode 141 may include tungsten. The cathode electrode 111 and the anode electrode 141 may have a disc shape. The gate electrode 112 and the focus electrode 113 may each include an opening for allowing the electron bean EB to pass therethrough. The gate electrode 112 and the focus electrode 113 may each include one opening, but may each include a plurality of openings.

The insulation rings 120 may include an insulation ceramic material such as alumina the bonding surface of which is metallized. In this case, the cathode electrode 111, the gate electrode 112, and the focus electrode 113 may be formed of a metal having a thermal expansion coefficient similar to that of alumina, for example, Kovar alloy and Alloy-42.

Between the gate electrode 112 and the anode electrode 141, a first conductive tube 131, a second conductive tube 132, and a third conductive tube 133 may be provided. The first conductive tube 131 may be spaced apart from the focus electrode 113 by the third insulation ring 123 interposed therebetween. The third conductive tube 133 may be connected to the anode electrode 141. As an example, the conductive tubes 131 to 133 may include a paramagnetic material which is not affected by a magnetic field, for example, copper.

Between the conductive tubes 131 to 133, an insulation spacer may be provided. As an example, between the first conductive tube 131 and the second conductive tube 132, a first insulation spacer 126 may be provided, and between the second conductive tube 132 and the third conductive tube 133, a second insulation spacer 127 may be provided. Alternatively, only one insulating spacer may be provided. The first and the second insulation spacers 126 and 127 may electrically separate the conductive tubes 131 to 133. As an example, the first and the second insulation spacers 126 and 127 may include an insulation ceramic material such as alumina the bonding surface of which is metallized.

A first collimator block 151 covering an inner surface S2 of the first insulation spacer 126 and having a first opening OP1 may be provided. A diameter W1 in a second direction D2 of first opening OP1 of The first collimator block 151 may control an incident angle and a radiation angle of the electron beam EB passing through the first opening OP1. The first collimator block 151 may be electrically connected to the first conductive tube 131. That is, the first collimator block 151 and the first conductive tube 131 may be in an equipotential state. As an example, the first collimator block 151 may be electrically connected to the first conductive tube 131 by diffusion bonding of a brazing filler used in vacuum closing.

As an example, the first collimator block 151 may include a flange part FP protruding toward an inner side wall of the first conductive tube 131. The first collimator block 151 may cover the inner surface S2 of the first insulation spacer 126 and a first side wall S1 which are exposed in a proceeding direction of the electron beam EB to prevent the damage or the electrical charging of the first insulation spacer 126 due to the electron beam EB. Alternatively, a second side wall S3 of the first insulation spacer 126 which is not exposed in a proceeding direction of the electron beam EB may not be covered by the first collimator block 151. The first collimator block 151 may be spaced apart from the inner surface S2 by a gap region GP interposed therebetween so that the first collimator block 151 may not be electrically connected to the second side wall S3. As an example, some portions of the inner surface S2 may come in contact with the first collimator block 151, and the other portions may be spaced apart from the first collimator block 151 by the gap region GP interposed therebetween.

The first collimator block 151 may be formed of a material capable of shielding (such as tungsten or molybdenum), or may be formed to have a thickness capable of shielding so that an unintentional X-ray is not generated by an electron beam screened thereby.

A second collimator block 152 covering an inner surface of the second insulation spacer 127 and having a second opening OP2 may be provided. The diameter of the second opening OP2 may be smaller than that of the first opening OP1. The second collimator block 152 may be electrically connected to the second conductive tube 132. The shape, the manufacturing method, and/or other features of the second collimator block 152 may be the same as or similar to those of the first collimator block 151.

The trajectory of the electron beam EB generated from the nano-emitter NE may be corrected by the first deflector 220 so as to pass through the first opening OP1 of the first collimator block 151 as much as possible. For an accurate trajectory correction, the degree of the electron beam EB to be screened by the first collimator block 151 without passing through the first opening OP1 may be measured. As an example, electrons which have not passed through the first opening OP1 may collide with the first conductive tube 131 or the first collimator block 151. Therefore, the current flowing in the first conductive tube 131 and the first collimator block 151 which are electrically connected to each other may be measured by a first current meter 271 to focus the electron beam EB by controlling the first deflector 220 under the condition in which the current is minimized. Similarly, the current flowing in the second conductive tube 132 and the second collimator block 152 may be measured by using a second current meter 272 to focus the electron beam EB by controlling the second deflector 230 under the condition in which the current is minimized.

For such a focusing method, the first conductive tube 131 and the first collimator block 151 may be electrically separated from the second conductive tube 132 and the second collimator block 152 by the first insulation spacer 126. Also, the second conductive tube 132 and the second collimator block 152 may be electrically separated from the third conductive tube 133 by the second insulation spacer 127.

The first insulation spacer 126 and the first collimator block 151 may be disposed in a position in which the intensity of magnetic field is relatively high in the vacuum closed tube 100 so that the moving direction of electrons in the electron beam EB is bent. As an example, the first insulation spacer 126 and the first collimator block 151 may be disposed on an inner side of a condenser lens, that is, the first magnetic lens 240. As an example, the first insulation spacer 126 and the first collimator block 151 may be disposed between the first deflector 220 and the second deflector 230. The second insulation spacer 127 and the second collimator block 152 may be disposed on an inner side of an objective lens, that is, the second magnetic lens 250. As an example, the second insulation spacer 127 and the second collimator block 152 may be disposed between the second deflector 230 and the anode electrode 141.

Referring to FIGS. 4, 5, 7A, and 7B, the positions of the first collimator block 151 and the second collimator block 152 will be described in more detail.

The first collimator block 151 may be disposed in the first core region C1, and the second collimator block 152 may be disposed in the second core region C2. As an example, as shown in FIG. 7A, the second magnetic structure 251 may include a second gap portion GG2 defined by a first surface 251_S1 and a second surface 251_S2 in the second core region C2. The second collimator block 152 may include an inner surface OS2 connected to the second opening OP2. The electron beam EB may include an emission region R1 and a focusing region R2, and the second collimator block 152 may be disposed in the focusing region R2. The inner surface OS2 may be disposed in the second gap portion GG2. As an example, the distance t1 between the inner surface OS2 and the first surface 251_S1 may be substantially the same as the distance t2 between the inner surface OS2 and the second surface 251_S2. Accordingly, an unintentional X-ray emitted by the electron beam EB colliding with the inner surface OS2 may be reduced.

Similarly, the first magnetic structure 241 may include a first gap portion GG1 defined by a first surface 241_S1 and a second surface 241_S2 in the first core region C1. The first collimator block 151 may include an inner surface OS1 connected to the first opening OP1. The distance t3 between the inner surface OS1 and the first surface 241_S1 may be substantially the same as the distance t4 between the inner surface OS1 and the second surface 241_S2.

The vacuum closed tube 100 may be formed by vacuum closing the electrodes 111, 112, 113, and 141 and the conductive tubes 131 to 133, all of which are metal materials, and the insulation rings 120 and the insulation spacers 126 and 127, all of which are ceramic materials. As an example, the vacuum closing method may include inserting a brazing filer between each component and heating the same to a predetermined temperature in a vacuum. Although now shown, a non-volatile or volatile getter may be disposed inside the vacuum closed tube 100.

In the case of a thermoelectric resource such as a tungsten tip emitter or $LaB_6$, the size of an initial electron source is very small, thereby having properties advantageous for electron beam focusing. A single carbon nano-tube has a smaller electron source area in which electrons are emitted compared with such thermoelectric resources. However, in the case of a nano-emitter in which several nano materials are assembled, such as yarn and a printed paste CNT emitter, since an emission current is large but the size of an electron source is large, there may be a limitation in focusing an electron beam reaching a target to a very small scale. Therefore, it may be useful to limit the emitted electron beam to make the size of the electron beam small. Hereinafter, a focusing method of an electron beam according to a cathode electrode side configuration will be described.

Figure 8A:
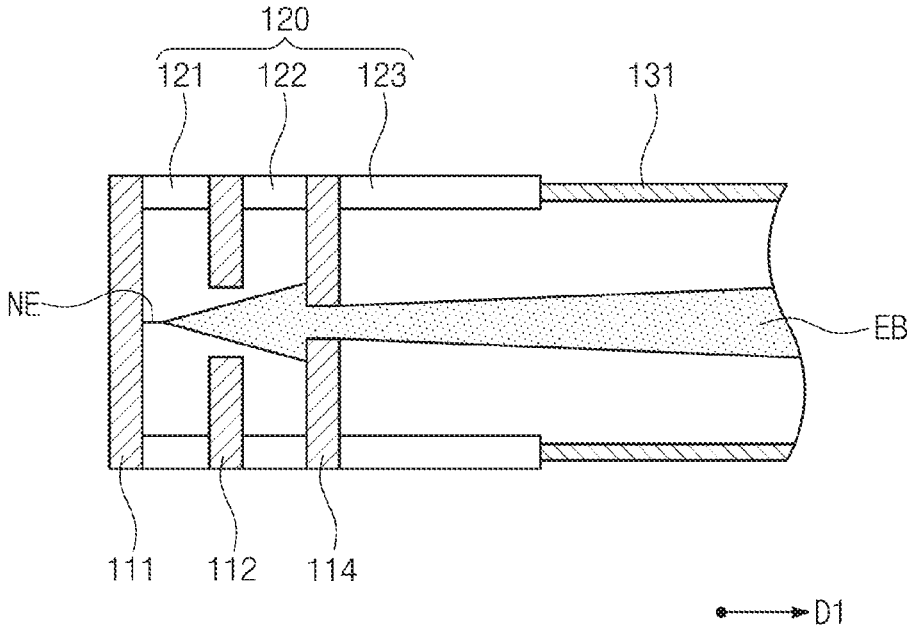
FIGS. 8A to 8C are cross-sectional views illustrating the structure of a cathode side electrode according to embodiments of the inventive concept.
Figure 8B:
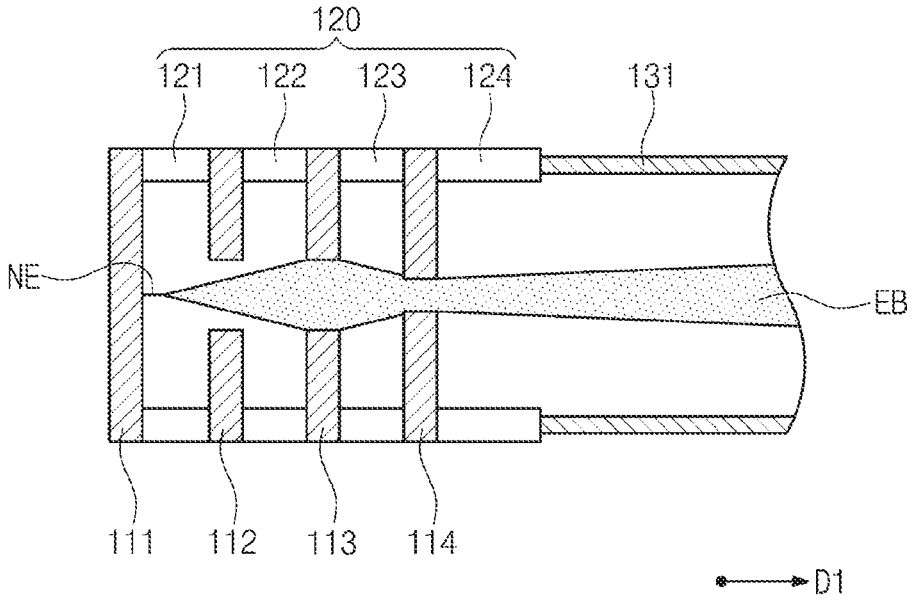
Figure 8C:
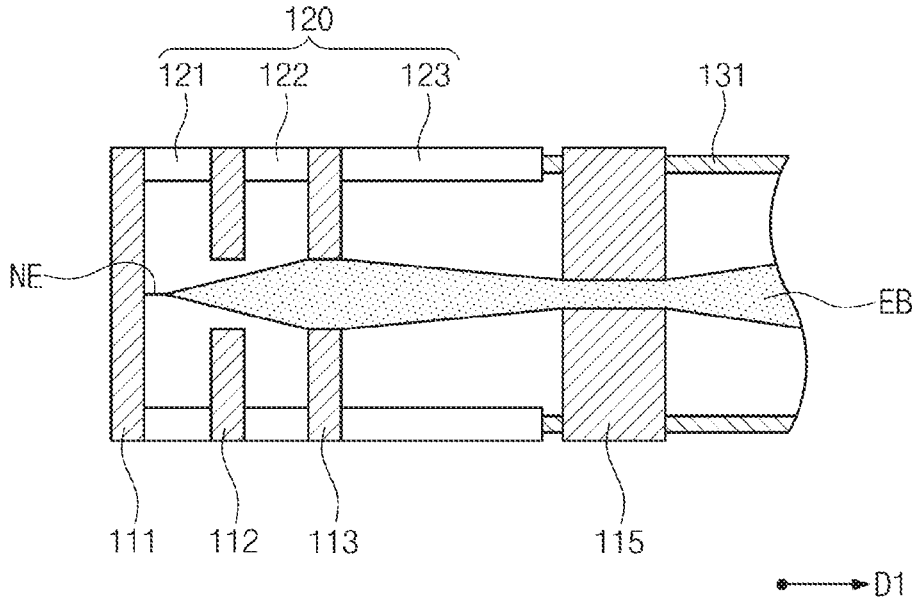

FIGS. 8A to 8C are cross-sectional views illustrating the structure of a cathode side electrode according to embodiments of the inventive concept.

Referring to FIG. 8A, the cathode electrode 111, the gate electrode 112, and a collimator electrode 114 may be disposed along the first direction D1 in order. The cathode electrode 111, the gate electrode 112, and the collimator electrode 114 may be electrically separated from each other by the insulation rings 120. The collimator electrode 114 may be electrically separated from the first insulation tube 141 by the third insulation ring 123. The collimator electrode 114 may include an opening having a diameter relatively smaller than that of the gate electrode 112, and the diameter of the electron beam EB passing through the same may be limited by the opening. As a result, the diameter of the electron beam EB which has passed through the collimator electrode 114 may be reduced.

Referring to FIG. 8B, the cathode electrode 111, the gate electrode 112, the focus electrode 113, and the collimator electrode 114 may be disposed along the first direction D1 in order. The electron beam EB having the diameter reduced by the focus electrode 113 passes through the collimator electrode 114 so that the transmittance rate of the electron beam EB passing through the opening of the collimator electrode 114 may be increased.

Referring to FIG. 8C, the cathode electrode 111, the gate electrode 112, the focus electrode 113, and a collimator electrode 115 may be disposed along the first direction D1 in order. The collimator electrode 115 may have a voltage higher than that of the cathode electrode 111 compared with the collimator electrode 114 of FIG. 8B. Accordingly, the electron beam EB reaching the collimator electrode 115 may be accelerated enough to be able to generate an X-ray. As an example, the collimator electrode 115 may be disposed in the first conductive tube 131, and may have the same potential as the first conductive tube 131.

Figure 9:
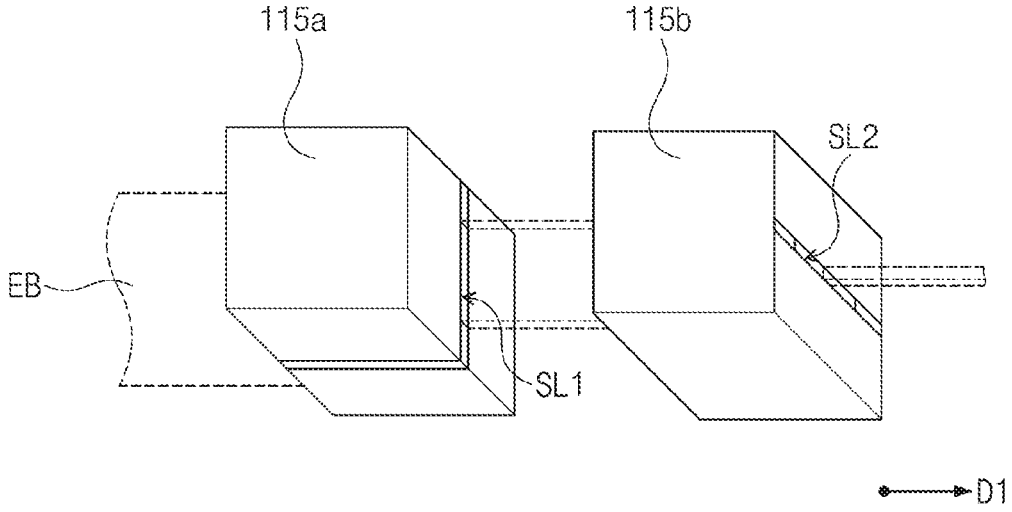
FIG. 9 is an exploded perspective view illustrating an embodiment of a collimator electrode.

The collimator electrode 115 may be formed of a material capable of shielding electron beams (such as tungsten or molybdenum), or may be formed to have a thickness capable of shielding electron beams so that an unintentional X-ray is not generated by the electron beam EB which has reached the collimator electrode 115. As an example, the collimator electrode 115 may be thicker than the gate electrode 112. The collimator electrode 115 may have the form of a single metal plate including one opening. Alternatively, the collimator electrode 115 may have the form of a plurality of metal plates. FIG. 9 is an exploded perspective view illustrating an embodiment of a collimator electrode. A collimator electrode according to an embodiment of the inventive concept may include a first collimator electrode 115*a* and a second collimator electrode 115*b*. The first collimator electrode 115*a* may include a first slit SL1, and the second collimator electrode 115*b* may include a second slit SL2. The first slit SL1 and the second slit 2 may be perpendicular to each other.

Figure 10:
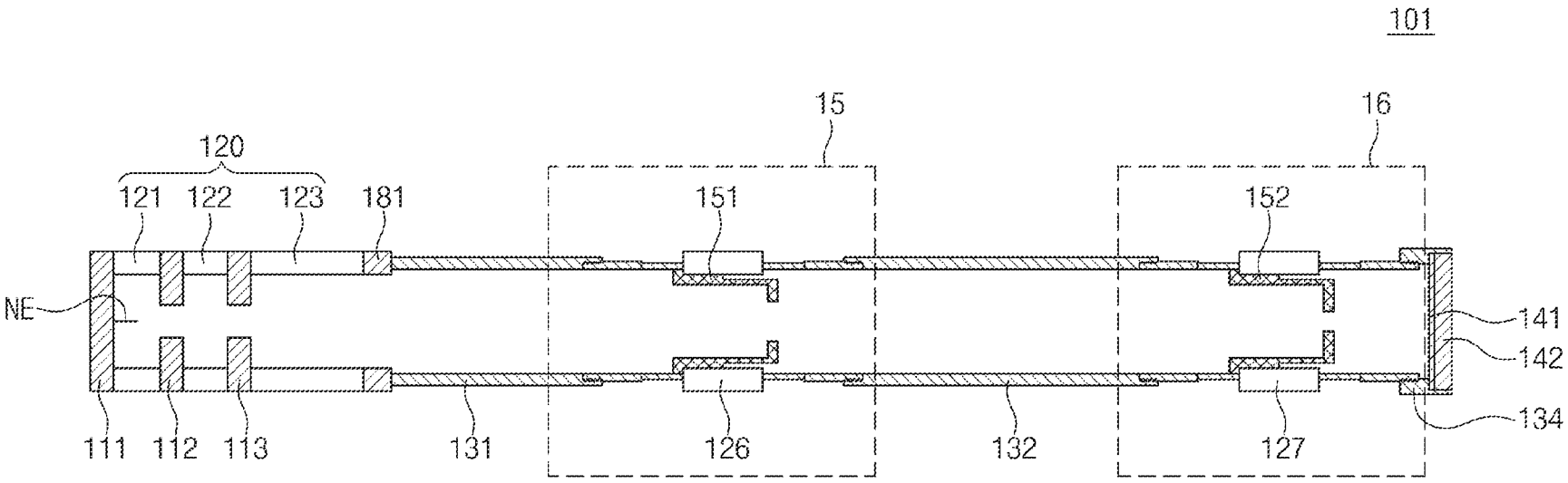
FIG. 10 is a cross-sectional view of a vacuum closed tube according to embodiments of the inventive concept.
Figure 11:
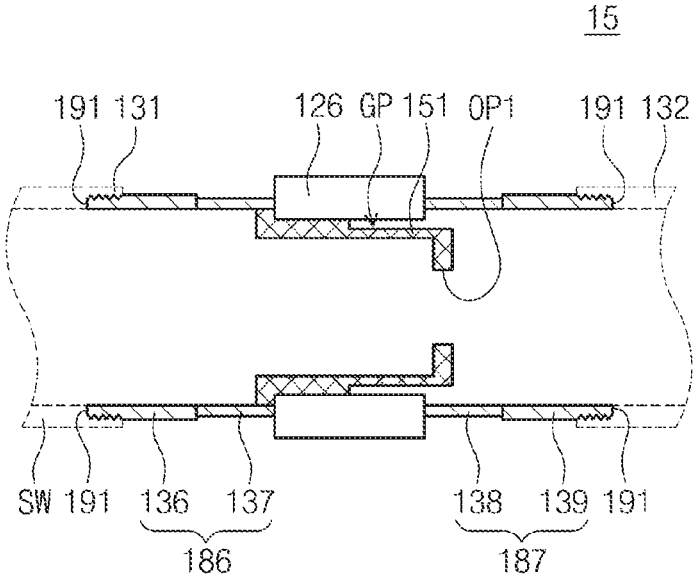
FIG. 11 is an enlarged view of a first spacer module of FIG. 10.

FIG. 10 is a cross-sectional view of a vacuum closed tube 101 according to embodiments of the inventive concept. FIG. 11 is an enlarged view of a first spacer module of FIG. 10. In order to simplify the explanation, descriptions of the same components may be omitted.

Referring to FIGS. 10 and 11, the vacuum closed tube 101 according to the embodiment may include a buffer layer 181 between the insulation rings 120 and the first conductive tube 131. As an example, in the cases in which the insulation rings 120 are manufactured of alumina, and the first conductive tube 131 is manufactured of copper, the buffer layer 181 may be formed of a material capable of alleviating different coefficients of thermal expansion between the two materials, thereby being capable of minimizing the stress generated between heterogeneous materials. As an example, the buffer layer 181 may include a Kovar alloy, alloy-42, and the like. The vacuum closed tube 101 may include a first spacer module 15 and a second space module 16. The first and the second spacer modules 15 and 16 may be modules for coupling with the first to the third conductive tubes 131, 132, and 134. As an example, the first spacer module 15 may include a fourth conductive tube 186 and a fifth conductive tube 187 disposed at both sides of the first insulation spacer 126. In addition, the first spacer module 15 may include the first collimator block 151 to be coupled with the first insulation spacer 126, and the first collimator block 151 may be connected to the fourth conductive tube 186. The first insulation spacer 126, the fourth and the fifth conductive tubes 186 and 187 may be manufactured by brazing bonding before the screw coupling to be described below. Accordingly, the vertical alignment of the vacuum closed tube 101 may be improved, and the stress applied to a brazing bonding portion during the alignment process may be alleviated.

As an example, the fourth conductive tube 186 may include a first sub-conductive tube 136 and a second sub-conductive tube 137 which have different thicknesses from each other's. The first sub-conductive tube 136 may include a screw thread SW which may be screw-coupled with the first conductive tube 131. The second sub-conductive tube 137 may be thinner than the first sub-conductive tube 136. The fifth conductive tube 187 may include a third sub-conductive tube 138 and a fourth sub-conductive tube 139 which have different thicknesses from each other's. The fourth sub-conductive tube 139 may include a screw thread SW which may be screw-coupled with the second conductive tube 132. The third sub-conductive tube 138 may be thinner than the fourth sub-conductive tube 139. As an example, the second sub-conductive tube 138 and the fourth sub-conductive tube 138 may be manufactured by processing a copper tube having a diameter about 8 mm to a thickness of about 0.3 mm.

The first sub-conductive tube 136 and the fourth sub-conductive tube 139 may each be screw-coupled with the first conductive tube 131 and the second conductive tube 132. That is, at each end of the first and the second conductive tubes 131 and 132, a screw thread may be provided. When the first spacer module 15 is screw-coupled with the first and the second conductive tubes 131 and 132, the length of the vacuum closed tube 101 may be controlled by controlling the length of the screw thread to be formed. When screw-coupling, a ring-type brazing filler (not shown) may be added to a screw-coupling portion 191 to perform the final closing.

The second spacer module 16 may also be formed in substantially the same shape and by substantially the same manufacturing method as the first spacer module 15. As an example, the second spacer module 16 may be screw-coupled with the second conductive tube 132 and the third conductive tube 134. The third conductive tube 134 may be formed to surround the outer circumferences of the anode electrode 141 and the window 142.

According to embodiments of the inventive concept, an X-ray source not requiring a vacuum pumping system is provided. In addition, an X-ray source for providing an electron beam focused into a nano-size scale may be provided. An X-ray source according to embodiments of the inventive concept may include a vacuum closing tube with improved insulation properties to facilitate separation. Also, a vacuum closed tube according to embodiments of the inventive concept may measure the degree of focusing while protecting an insulation spacer.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. An X-ray source comprising:

a high voltage connection module, a tube module, and a magnetic lens system into which the tube module is inserted, wherein the tube module includes a vacuum closed tube, and the vacuum closed tube includes:

a cathode electrode provided at one end thereof;

an emitter on the cathode electrode;

an anode electrode provided at the other end;

a first insulation spacer provided between the cathode electrode and the anode electrode;

a first conductive tube and a second conductive tube both provided between the cathode electrode and the anode electrode and separated from each other by the first insulation spacer; and a first collimator block covering an inner surface of the first insulation spacer and having a first opening.

2. The X-ray source of claim 1, wherein the first collimator block is electrically connected to the first conductive tube.

3. The X-ray source of claim 1, wherein the first collimator block comprises a flange part protruding toward an inner surface of the first conductive tube.

4. The X-ray source of claim 1, wherein the magnetic lens system comprises a magnetic structure including a gap portion and a coil in the magnetic structure, and the first collimator block is disposed in the gap portion.

5. The X-ray source of claim 4, wherein the gap portion is defined by a first surface and a second surface of the magnetic structure, and the distance between an inner surface of the first collimator block connected to the first opening and the first surface is substantially the same as the distance between the inner surface and the second surface.

6. The X-ray source of claim 1, wherein the vacuum closed tube further comprises:

a third conductive tube spaced apart from the first conductive tube by the second conductive tube interposed therebetween;

a second insulation spacer separating the second conductive tube and the third conductive tube; and a second collimator block covering an inner surface of the second insulation spacer and having a second opening.

7. The X-ray source of claim 6, wherein the diameter of the second opening is smaller than the diameter of the first opening.

8. The X-ray source of claim 1, wherein the high voltage connection module comprises a first insulation part, the tube module comprises a second insulation part, and the first insulation part and the second insulation part each include a concave-convex structure.

9. The X-ray source of claim 1, wherein the vacuum closed tube further comprises:

a fourth conductive tube between the first conductive tube and the first insulation spacer; and a fifth conductive tube between the second conductive tube and the first insulation spacer.

10. The X-ray source of claim 9, wherein the fourth conductive tube is screw-coupled with the first conductive tube, and the fifth conductive tube is screw-coupled with the second conductive tube.

11. The X-ray source of claim 9, wherein the fourth conductive tube comprises a first sub-conductive tube and a second sub-conductive tube, and the second sub-conductive tube is thinner than the first sub-conductive tube.

12. A vacuum closed tube comprising:

a cathode electrode and an anode electrode;

an emitter on the cathode electrode;

a first insulation spacer provided between the cathode electrode and the anode electrode;

a first conductive tube and a second conductive tube both provided between the cathode electrode and the anode electrode and separated from each other by the first insulation spacer, the emitter positioned past an end of the first conductive tube in an axial direction of the first conductive tube; and a first collimator block covering an inner surface of the first insulation spacer, electrically connected to the first conductive tube, and having a first opening.

13. The vacuum closed tube of claim 12, wherein the first collimator block comprises a flange part protruding toward an inner surface of the first conductive tube.

14. The vacuum closed tube of claim 12 further comprises:

a third conductive tube spaced apart from the first conductive tube by the second conductive tube interposed therebetween;

a second insulation spacer separating the second conductive tube and the third conductive tube; and a second collimator block covering an inner surface of the second insulation spacer, electrically connected to the second conductive tube, and having a second opening.

15. The vacuum closed tube of claim 12, wherein the first collimator block is located radially inward of the first insulation spacer and extends past each end of the first insulation spacer in the axial direction.

16. The vacuum closed tube of claim 12, further comprising an insulation ring between the cathode and the first conductive tube in the axial direction, wherein the emitter is located radially inward of the insulation ring.

17. The vacuum closed tube of claim 12, wherein an outer circumferential surface of the first collimator block is in contact with an inner circumferential surface of the first insulation spacer.

* * * * *